US007707984B2

(12) United States Patent
Colet et al.

(10) Patent No.: US 7,707,984 B2
(45) Date of Patent: May 4, 2010

(54) METHOD AND SYSTEM FOR CONTROLLING A LOW-VOLTAGE-POWERED PLUG FOR PREHEATING A DIESEL ENGINE AIR/FUEL MIXTURE

(75) Inventors: Francois Colet, Bois-Colombes (FR); Richard Roth, Nanterre (FR); Nicolas Palanque, Vicennes (FR)

(73) Assignee: Renault S. A. S., Boulogne Billancourt (FR)

( * ) Notice: Subject to any disclaimer, the term of this patent is extended or adjusted under 35 U.S.C. 154(b) by 0 days.

(21) Appl. No.: 12/491,263

(22) Filed: Jun. 25, 2009

(65) Prior Publication Data

US 2009/0326785 A1 Dec. 31, 2009

Related U.S. Application Data

(63) Continuation of application No. 12/280,171, filed as application No. PCT/FR2007/050747 on Feb. 5, 2007, now abandoned.

(30) Foreign Application Priority Data

Feb. 23, 2006 (FR) ..... 06 01610

(51) Int. Cl.
*F02P 19/02* (2006.01)

(52) U.S. Cl. ..... 123/145 A; 123/605

(58) Field of Classification Search ..... 123/143 R, 123/143 A, 605, 623
See application file for complete search history.

(56) References Cited

U.S. PATENT DOCUMENTS

| | | | | | |
|---|---|---|---|---|---|
| 4,714,068 | A | * | 12/1987 | Nagase et al. | 123/506 |
| 4,862,370 | A | * | 8/1989 | Arnold et al. | 701/113 |
| 6,138,653 | A | * | 10/2000 | Juffinger | 123/598 |
| 2005/0039732 | A1 | | 2/2005 | Toedter et al. | |
| 2005/0081812 | A1 | | 4/2005 | Toedter et al. | |

FOREIGN PATENT DOCUMENTS

| | | |
|---|---|---|
| DE | 100 25 953 | 12/2001 |

* cited by examiner

*Primary Examiner*—John T Kwon
(74) *Attorney, Agent, or Firm*—Oblon, Spivak, McClelland, Maier & Neustadt, L.L.P.

(57) ABSTRACT

The invention relates to a method for controlling a low-voltage-powered plug (2) for preheating a diesel engine (1) air/fuel mixture. The plug (2) is powered by pulses having a predetermined amplitude and duration, said amplitude being less than a maximum amplitude (PWM_MAX). The amplitude and duration of the voltage pulses powering the plug (2) are controlled as a function of first parameters including the duration of the preceding pulses and the duration between successive preceding pulses.

17 Claims, 8 Drawing Sheets

METHOD AND SYSTEM FOR CONTROLLING A LOW-VOLTAGE-POWERED PLUG FOR PREHEATING A DIESEL ENGINE AIR/FUEL MIXTURE

CROSS REFERENCE TO RELATED APPLICATIONS

This application is a Continuation of and claims the benefit of priority under 35 U.S.C. §120 from U.S. Ser. No. 12/280,171 filed Aug. 21, 2008 which was the national stage of and claims the benefit of priority under 35 U.S.C. §119 from International Application No. PCT/FR07/50747 filed Feb. 5, 2007 which claimed the benefit of priority from French Patent Application No. 06 01610, filed on Feb. 23, 2006, the entire contents of each of which are incorporated herein by reference.

The present invention relates to a method and a system for controlling a low-voltage-powered plug for preheating a diesel engine air/fuel mixture.

A diesel engine requires a certain temperature for the combustion reaction of the air/fuel mixture to be able to take place. When the engine is cold, compression alone of the air/fuel mixture does not make it possible to reach the ignition temperature, and it is then necessary to preheat the air/fuel mixture by means of preheating plugs.

The ignition temperature is the temperature from which the combustion reaction of the air/fuel mixture becomes spontaneous.

There are systems and methods for managing the preheating of the diesel engine air/fuel mixture that use high-voltage preheating plugs controlled by DC voltage from the electrical voltage supplied by the battery.

A "high-voltage preheating plug" should be understood to be a plug that is powered at a nominal voltage of 11 volts, and "low-voltage preheating plug" should be understood to be a plug that is powered at a nominal voltage less than 11 volts (4.5 volts for example).

The high-voltage preheating plugs take longer than the low-voltage preheating plugs to reach the ignition temperature of the air/fuel mixture, because, during the so-called preheating BOOST phase, nominal 4.5 volt low-voltage plugs will be BOOST powered at 11 volts. Hence a very rapid rise in temperature. This is why the BOOST (boost power) duration must be perfectly controlled to avoid overheating leading to the deterioration of the plugs.

There are systems and methods for controlling low-voltage preheating plugs that use a temperature sensor to determine the temperature reached by the plug. The presence of such a temperature sensor involves a high cost.

Furthermore, a low-voltage preheating plug cannot withstand, without risk of deterioration, two very close-together intensive heating phases.

One aim of the invention is to propose an enhanced method and system for controlling a low-voltage preheating plug that is also inexpensive.

Thus, according to one aspect of the invention, there is proposed a method of controlling a low-voltage-powered plug for preheating a diesel engine air/fuel mixture. Said plug is voltage-powered by pulses having a predetermined amplitude and duration, the amplitude being less than a maximum amplitude. The amplitudes and the durations of the voltage pulses powering said plug are managed according to first parameters comprising preceding pulse durations and durations separating successive preceding pulses.

Thus, the preceding pulses delivered to the preheating plugs are taken into account, which makes it possible to avoid uses in which said plugs would be damaged.

Also, the use of a sensor for measuring the temperature supplied by the preheating plugs to the air/fuel mixture is avoided.

Furthermore, said first parameters comprise engine operating parameters, and/or an available electrical voltage from which is supplied the electric voltage powering said plug, and/or an indication representative of the activation/deactivation of the alternator of the engine, and/or a desired temperature to be supplied by said plug.

In one implementation, said operating parameters of the engine comprise the temperature of the coolant regulating the temperature of the engine, and/or atmospheric pressure, and/or the temperature of the fresh intake air of the engine, and/or the rotation speed of the engine.

Such data is generally already available because it is necessary to the operation of other devices on board the vehicle.

In one implementation, said management of the pulses comprises a preheating phase that can be implemented before starting the engine when the alternator is activated.

In one implementation, said management of the pulses comprises a heating phase that can be implemented while starting the engine.

In one implementation, said management of the pulses comprises a post-heating phase that can be implemented after starting the engine.

Furthermore, said management of pulses comprises a heating stop phase.

Advantageously, said management of the pulses comprises a top-up heating phase that can be implemented when the engine is running.

Advantageously, said preheating phase comprises a rapid preheating step implemented by one of said pulses of amplitude equal to said maximum amplitude.

Advantageously, said preheating phase comprises a preliminary rapid preheating step implemented by one of said pulses of a predetermined amplitude less than said maximum amplitude.

Furthermore, the production dispersion of the plug is taken into account, by mapping the duration of the pulse of said rapid preheating step, when the desired temperature to be supplied by the plug is greater than a threshold temperature, and by calculating the duration of the pulse of said rapid preheating step according to the square of the ratio of a reference electrical voltage and of an available electrical voltage from which is supplied the electrical voltage powering said plug, and according to a reference duration for reaching the desired temperature to be supplied by the plug under said reference electrical voltage at a reference temperature.

In one implementation, the production dispersion of the plug is taken into account, by progressively increasing the amplitude of said pulse of the heating phase on starting up the engine.

In one implementation, the amplitude of said pulse is increased when, on startup, the rotation speed of the engine does not reach a first predetermined rotation speed in a first predetermined duration.

For example, said progressive increase in the amplitude of the pulse is a function of said amplitude of the pulse, and is less than a maximum increase.

Advantageously, the wear over time of said plug is taken into account, by adapting the amplitudes of said pulses over the course of the time, by using a corrective factor dependent on the difference between a measured rotation speed of the engine and a reference rotation speed of the engine for a reference operating point of the engine.

In one embodiment, the temperature supplied by said plug is evaluated, and the amplitude of said predetermined pulses is adapted by using a closed loop proportional integral regulator.

According to another aspect of the invention, there is also proposed a system for controlling a low-voltage-powered plug for preheating a diesel engine fuel-air mixture, comprising controlled means of supplying voltage power to said plug adapted to deliver pulses having a predetermined amplitude and duration, the amplitude being less than a maximum amplitude. The system also comprises an electronic control unit provided with means of managing said power supply means, said electronic control unit being able to remain powered with voltage for a predetermined duration after a stoppage of the engine. Said management means comprise means of determining the value of first parameters comprising preceding pulse durations and durations separating successive preceding pulses.

Other aims, characteristics and advantages of the invention will become apparent from reading the following description, of a few by no means limiting examples, and referring to the appended drawings in which.

Figure 1:
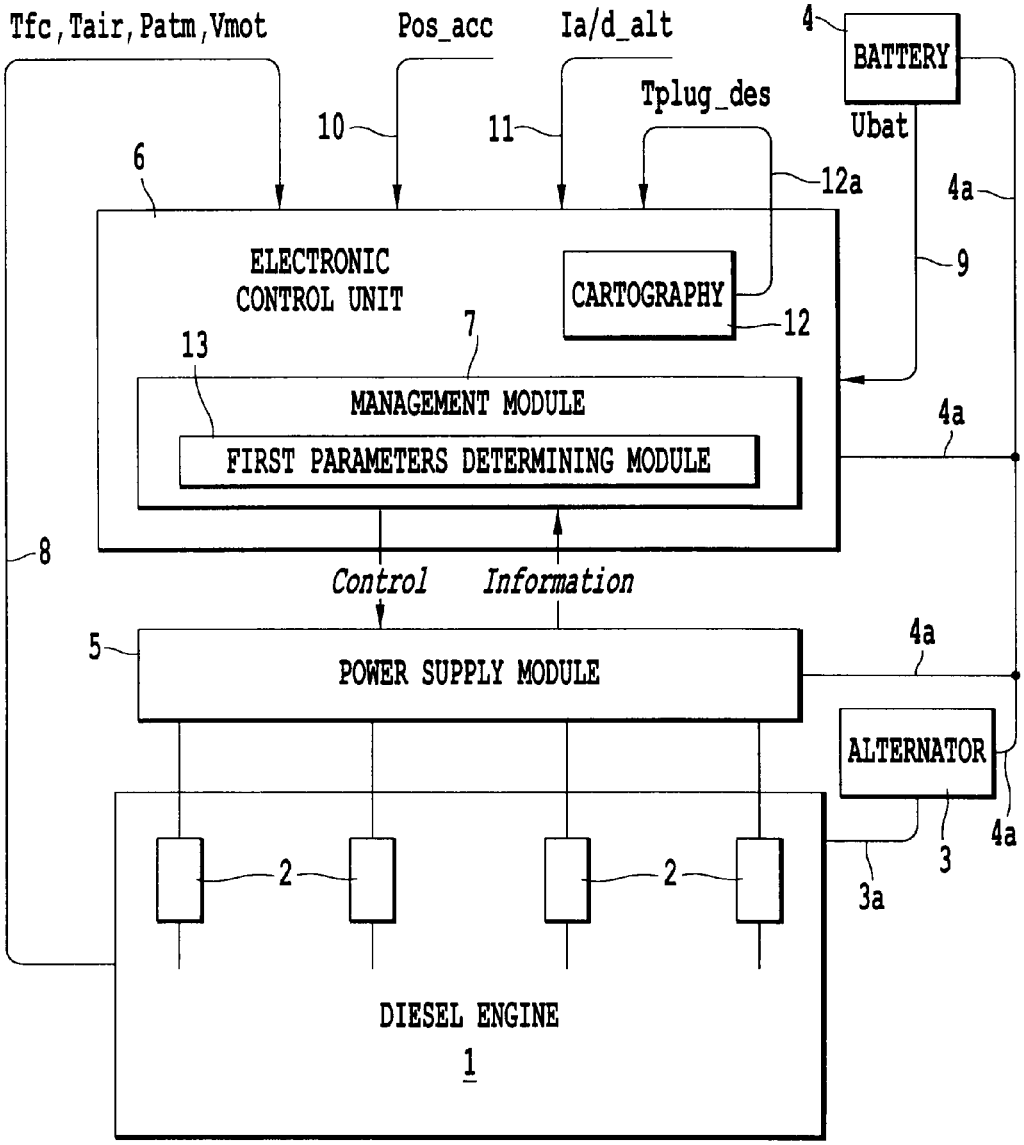
FIG. 1 represents one embodiment of a system according to one aspect of the invention.

As illustrated in FIG. 1, a diesel engine 1 is provided with four low-voltage-powered preheating plugs 2. An alternator 3 is linked to the diesel engine 1 by a connection 3*a*, and an electric battery 4 powers the system with electrical voltage via connections 4*a*.

A controlled voltage power supply module 5 for the preheating plugs 2 of the diesel engine 1 delivers pulses, having a predetermined amplitude and duration, to the preheating plugs 2.

An electronic control unit 6 comprises a management module 7 for the controlled voltage power supply module 5 for the plugs 2.

As a variant, the controlled module 5 can be a module belonging to the electronic control unit 6.

Determination means, for example sensors or calculation modules, can be used to determine operating parameters of the engine 1, and transmit them, via a connection 8, to the electronic control unit 6.

The operating parameters of the engine 1 comprise the temperature $T_{fc}$ of the coolant regulating the temperature of the engine 1, and/or the atmospheric pressure $P_{atm}$, and/or the temperature $T_{air}$ of the intake fresh air of the engine 1, and/or the rotation speed $V_{mot}$ of the engine 1.

The electronic control unit 6 also receives as input parameters, the available electrical voltage $U_{bat}$ supplied by the electrical power supply battery 4, a parameter $P_{os_acc}$ representative of the position of the accelerator pedal, and an indication $P_{a/d_alt}$ representative of the activation/deactivation of the alternator 3 of the engine 1, respectively via connections 9, 10 and 11.

Furthermore, the electronic control unit 6 receives as input a desired temperature $T_{plug_des}$ that the preheating plugs 2 must supply.

For example, the temperature $T_{plug_des}$ to be supplied by the preheating plugs 2 is provided by cartography 12 by means of a connection 12*a*, from parameters transmitted to the electronic control unit 6.

The management module 7 comprises a module 13 for determining the value of first parameters comprising preceding pulse durations and durations separating successive preceding pulses delivered by the controlled module 5 to the preheating plugs 2.

Figure 2:
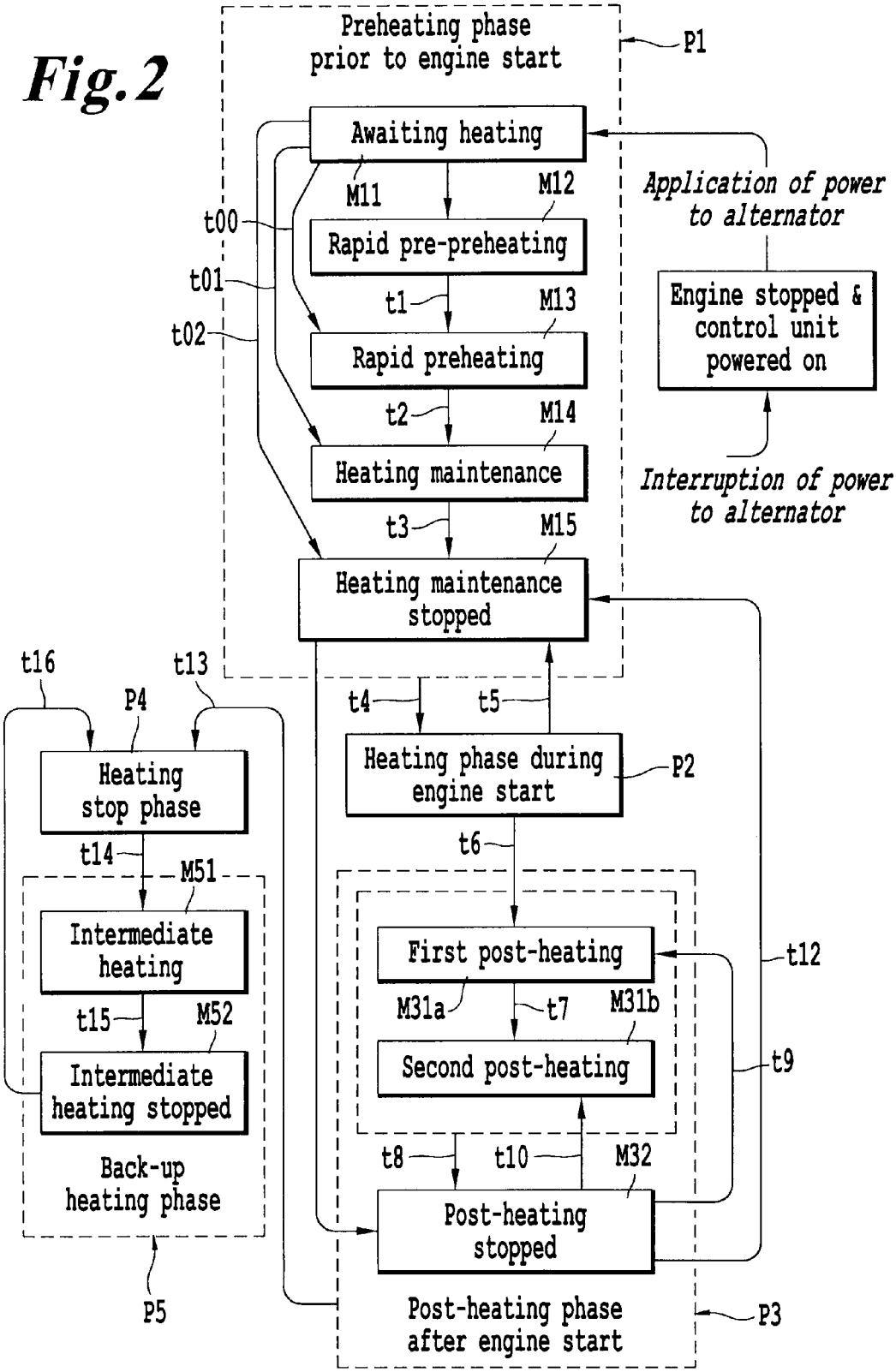
FIG. 2 is a block diagram of a method according to one aspect of the invention.

In FIG. 2, a phase P0 in which the engine is stopped, and the electronic control unit 6 is powered up or not is represented. The system is in this phase P0 following a cut in the power supply from the alternator 3, for example when the contact is cut by means of the switch key. For a predetermined duration, generally of the order of ten minutes, the electronic control unit 6 remains powered up, and beyond this predetermined duration, the electronic control unit 6 is no longer powered up.

A preheating phase P1 is provided for the heating of the air/fuel mixture by the preheating plugs 2 before the starting of the engine 1.

A heating phase P2 during a start of the engine is provided to heat the air/fuel mixture while the engine 1 is starting.

A post-heating phase P3 following a start of the engine 1 is provided for the heating of the air/fuel mixture by the preheating plugs 2 following a start of the engine 1.

A heating stop phase P4 is provided to stop the heating of the air/fuel mixture by the preheating plugs 2.

Furthermore, a top-up heating phase P5 is provided for heating of the air/fuel mixture, when necessary, while the engine 1 is in steady-state operation. This may be necessary, for example when running at altitude, where the reduced atmospheric pressure (less air) affects the performance of the engine (degraded combustion).

When the system is in the phase P0, and the alternator 3 is powered up, for example by turning a switch key in the starter, the preheating phase P1 prior to starting of the engine is selected.

The preheating phase P1 prior to the starting of the engine 1 comprises an awaiting heating step M11, a rapid preheating step M12, a rapid preheating step M13, a heating maintenance step M14, and a heating maintenance stoppage step M15.

Depending on the state of the engine 1, and the desired temperature of the air/fuel mixture supplied by the preheating plugs 2, a plurality of transitions between the steps of the preheating phase P1 prior to the starting of the engine 1 are possible.

In the awaiting heating step M11, the amplitude of the power supply pulse to the plugs is zero. In other words, the amplitude of the pulse powering a preheating plug 2, expressed as a percentage of the maximum amplitude PWM_MAX of a power supply pulse is: PWM_AWAITING_HEATING=0%.

The rapid preheating step M12 makes it possible, for electrical consumption issues, to power the preheating plugs 2 with an amplitude PWM_PRE_BOOST that is strictly less than 100% for a duration TIME_PRE_BOOST.

Moreover, it is possible to limit the amplitude PWM if the voltage $U_{bat}$ of the battery is too high, that is greater than a threshold voltage $U_s$.

Thus, if $U_{bat}$ is greater than $U_s$, the following applies:

$$PWM = \text{PWM_PRE_BOOST} \times \left(\frac{U_S}{U_{bat}}\right)^2$$

The duration TIME_PRE_BOOST of the rapid preheating step M12 depends on the durations of preceding pulses and durations separating successive preceding pulses, on the temperature $T_{fc}$ of the coolant regulating the temperature of the engine 1, on the temperature $T_{air}$ of the intake fresh air of the engine 1, on the available voltage $U_{bat}$ supplied by the battery 4, and on the atmospheric pressure $P_{atm}$.

The rapid preheating step M13 is implemented by means of a power supply pulse of amplitude equal to the maximum amplitude PWM_MAX, or in other words, expressed as a percentage of the maximum amplitude PWM_MAX, an amplitude PWM_BOOST=100% for a duration TIME_BOOST.

Moreover, if the voltage $U_{bat}$ supplied by the battery is greater than the threshold voltage $U_s$, it is possible to limit the amplitude PWM powering the plugs 2.

The heating maintenance step M14 is provided to maintain the desired temperature $T_{plug_des}$, reached at the end of the final completed rapid preheating step M13.

The desired temperature $T_{plug_des}$ is maintained for a duration of HEATING_MAINTENANCE_TIME which depends on the temperature $T_{fc}$ of the coolant, on the desired temperature $T_{plug_des}$, on the atmospheric pressure $P_{atm}$ and on the temperature $T_{air}$ of the intake fresh air.

The amplitude PWM_HEATING_MAINTENANCE depends on the voltage $U_{bat}$ supplied by the battery 4 and on the desired temperature $T_{plug_des}$ to be maintained. The temperature is dependent on the temperature $T_{fc}$ of the coolant, on the atmospheric pressure $P_{atm}$, and on the temperature $T_{air}$ of the intake fresh air.

If the startup has not been activated when the predetermined maximum duration MAX_HEATING_MAINTENANCE_TIME has elapsed, the heating is stopped to protect the preheating plugs 2.

The heating maintenance stop step M15 corresponds to a cutting of the heating just before the actual start of the heating phase P2 during a start of the engine 1. In this case, the amplitude PWM_HEATING_MAINTENANCE_STOP=0% (heating cut).

In the heating phase P2 during a start of the engine 1, the amplitude PWM_HEATING_START depends on the voltage $U_{bat}$ supplied by the battery 4 and the desired temperature $T_{plugs_des}$. The desired start temperature depends on the temperature $T_{fc}$ of the coolant, on the atmospheric pressure $P_{atm}$ and on the temperature $T_{air}$ of the intake air.

The post-heating phase P3 following a start of the engine 1 comprises a post-heating step M3 comprising two steps M31$_a$ and M31$_b$, first post-heating and second post-heating respectively, and a post-heating stop step M32.

During the post-heating step M31, for preheating plug 2 reliability issues, the latter cannot be maintained at a high temperature for too long a time.

For example, while a plug 2 may withstand a temperature of 1000° C. for three post-heating minutes, it may not be able to withstand 1100° C. for any longer than just 15 seconds.

Two post-heating substeps M31$_a$ and M31$_b$ are therefore used: a first post-heating substep M31$_a$ with duration of temperature that can be adjusted according to the initial conditions of the engine, that is, before startup; and a second post-heating substep M31$_b$ with duration of temperature that are variable depending on the operating conditions of the engine 1.

There are therefore two desired post-heating temperatures, POST_HEATING_TEMPERATURE_1 and POST_HEATING_TEMPERATURE_2, which have two respective corresponding control amplitudes PWM_POST_HEATING_1 and PWM_POST_HEATING_2.

The temperature POST_HEATING_TEMPERATURE_1 depends on the temperature $T_{fc}$ of the coolant, on the temperature obtained at the end of the rapid preheating step M13, on the atmospheric pressure $P_{atm}$ and on the temperature $T_{air}$ Of the intake air of the engine 1.

The temperature POST_HEATING_TEMPERATURE_2 depends on the temperature $T_{fc}$ of the coolant, on the temperature POST_HEATING_TEMPERATURE_1, on the atmospheric pressure $P_{atm}$, on the temperature $T_{air}$ of the intake air, on the rotation speed $V_{mot}$ of the engine, and on the engine torque $C_{mot}$.

The amplitudes PWM of the control pulses PWM_POST_HEATING_1 and PWM_POST_HEATING_2 depend on the voltage $U_{bat}$ supplied by the battery 4 and on the respective post-heating temperatures POST_HEATING_TEMPERATURE_1 and POST_HEATING_TEMPERATURE_2.

The post-heating stop step M32 corresponds to a cut in the heating supplied by the preheating plugs 2, the amplitude of the control pulses is 0 or in other words, expressed as a percentage of the maximum amplitude, PWM_MAX, PWM_POST_HEATING_STOP=0%.

The heating stop phase P4 corresponds to a zero control amplitude, or in other words, expressed as a percentage of the maximum amplitude, PWM_HEATING_STOP=0%.

The top-up heating phase P5 comprises an intermediate heating step M51, and an intermediate heating stop step M52.

During the intermediate heating step M51, the assistance of the preheating plugs 2 is invoked, for example when combustion is degraded because the engine is running at altitude, or for any particular thermal need in the engine's combustion chamber. The intermediate heating temperature, to be supplied by the preheating plugs 2, depends on the temperature $T_{fc}$ of the coolant, on the atmospheric pressure $P_{atm}$, on the air intake temperature $T_{air}$, on the rotation speed $V_{mot}$ of the engine 1, and on the engine torque $C_{mot}$. The amplitude PWM_INTERMEDIATE_HEATING depends on the voltage $U_{bat}$ supplied by the battery 4 and on the desired intermediate heating temperature $T_{plug_des}$.

The intermediate heating stop step M52 corresponds to a cut in the heating of the preheating plugs 2, with a pulse expressed as a percentage of the maximum amplitude PWM_INTERMEDIATE_HEATING_STOP=0%.

The sequencing of these various steps and phases is handled by transitions that depend on various conditions.

The management of the transitions $t_i$ uses time counters. The time counters concerned are as follows.

The time counters can be implemented by software, or by dedicated electronic circuits.

A time counter COUNTER_POWER_LATCH is set to zero on each entry into the phase P0, when the voltage power supply to the alternator 3 is cut, for example by a contact switch.

The time counter COUNTER_HEATING_MAINTENANCE is set to zero on each entry, via the transitions $t_2$ or $t_{02}$, into the heating maintenance step M14.

A time counter COUNTER_HEATING_MAINTENANCE_STOP is set to zero on each entry into the heating maintenance stop step M15, via the transitions $t_{03}$ or $t_3$, and on each exit from the preheating phase P1 via the transition $t_4$.

A time counter COUNTER_POST_HEATING is set to zero on each entry into the post-heating step M31, via the transition $t_6$.

A time counter COUNTER_POST_HEATING_1 is set to zero on each entry into the first post-heating substep M31*a* via the transition $t_6$.

A time counter COUNTER_POST_HEATING_2 is set to zero on each entry into a second post-heating substep M31*b*, via the transition $t_6$ and on each return to the second post-heating substep M31*b* via the transition $t_{10}$.

A time counter COUNTER_BOOST encompasses the preheating M12 and rapid preheating M13 steps. Its incrementation starts with the preheating step M12 and continues in the rapid preheating step M13. The counting or timing ends on exiting the rapid preheating step M13.

The counter COUNTER_BOOST always restarts from the last value retained in memory as long as it has not been set to zero. The time counter COUNTER_BOOST is set to zero each time the sum of the time counters COUNTER_POWER_LATCH+COUNTER_HEATING_MAINTENANCE_STOP exceeds a time threshold $t_{thresh_ref}$ necessary for the cooling of the plug, normally of the order of 1 to 4 minutes.

A time counter COUNTER_INTERMEDIATE_HEATING is set to zero on each entry into the intermediate heating step M51 via the transition $t_{14}$.

A time counter COUNTER_INTERMEDIATE_HEATING_STOP is set to zero on each entry into the intermediate heating stop step M52 via the transition $t_{15}$.

Regarding the transition too, between the awaiting heating step M11 and the rapid preheating step M12, there is the sum TIME_PRE_BOOST+TIME_BOOST, which is a first function F1 of the temperature $T_{fc}$ of the coolant, of the atmospheric pressure $P_{atm}$, of the intake air temperature $T_{air}$, and of the voltage $U_{bat}$ of the battery.

Furthermore, the time counter TIME_PRE_BOOST is a second function F2 of the temperature $T_{fc}$ of the coolant, of the atmospheric pressure $P_{atm}$, of the air intake temperature $T_{air}$, of the voltage $U_{bat}$ supplied by the battery 4, and the time counter TIME_BOOST is a third function F3 of the temperature $T_{fc}$ of the coolant, of the atmospheric pressure $P_{atm}$, of the intake air temperature $T_{air}$ and of the voltage $U_{bat}$ supplied by the battery 4.

When $F_1$ ($T_{fc}$; $P_{atm}$; $T_{air}$; $U_{bat}$) is strictly positive, and the sum COUNTER_POWER_LATCH+COUNTER_HEATING_MAINTENANCE_STOP is greater than the time threshold $t_{thresh_ref}$, then the transition $t_{00}$ is true, or, in other words, the transition $t_{00}$ is carried out.

Furthermore, when $F_1$ ($T_{fc}$; $P_{atm}$; $T_{air}$; $U_{bat}$) is strictly positive, when the sum COUNTER_POWER_LATCH+COUNTER_HEATING_MAINTENANCE_STOP is less than the time threshold $t_{thresh_ref}$, and when COUNTER_BOOST is less than TIME_PRE_BOOST, then the transition $t_{00}$ is true, or, in other words, the transition $t_{00}$ is carried out.

Regarding the transition $t_{01}$, when $F_1$ ($T_{fc}$; $P_{atm}$; $T_{air}$; $U_{bat}$) is strictly positive, when the sum COUNTER_POWER_LATCH+COUNTER_HEATING_MAINTENANCE_STOP is less than the time threshold $t_{thresh_ref}$, and when TIME_PRE_BOOST is less than COUNTER_BOOST which is less than TIME_PRE_BOOST+TIME_BOOST, then the transition $t_{01}$ is true, or, in other words, the transition $t_{01}$ is carried out.

For the transition $t_{02}$, if $F_1$ ($T_{fc}$; $P_{atm}$; $T_{air}$; $U_{bat}$) is strictly positive, when $t_{thresh_min}$ is less than the sum COUNTER_POWER_LATCH+COUNTER_HEATING_MAINTENANCE_STOP, less than $t_{thresh_ref}$ and COUNTER_BOOST is greater than the sum TIME_BOOST+TIME_PRE_BOOST, then the transition $t_{02}$ is carried out.

The minimum threshold delay $t_{thresh_min}$ corresponds to the minimum waiting delay from the end of a rapid preheating step M13, to be able to restart a rapid preheating step M13 or a rapid preheating step M12.

The transition $t_{03}$ is carried out when the temperature $T_{fc}$ of the coolant, the atmospheric pressure $P_{atm}$ and the intake air temperature $T_{air}$ are such that the preheating phase P1 is unnecessary.

When $F_1$ ($T_{fc}$; $P_{atm}$; $T_{air}$; $U_{bat}$) is zero, or if the sum COUNTER_POWER_LATCH+COUNTER_HEATING_MAINTENANCE_STOP is less than $t_{thresh_min}$, and COUNTER_BOOST is greater than the sum TIME_BOOST+TIME_PRE_BOOST, then the transition $t_{03}$ is carried out.

The transition $t_1$ is a transition from the rapid preheating step M12 to the rapid preheating step M13.

If COUNTER_BOOST is greater than TIME_BOOST, then the transition $t_1$ is carried out and the rapid preheating step M13 begins.

The transition $t_2$ represents the passage from the preheating step M13 to the heating maintenance step M14.

When COUNTER_BOOST is greater than the sum TIME_PRE_BOOST+TIME_BOOST, the transition $t_2$ is carried out, and the rapid preheating step M13 ends.

The transition $t_3$ represents the stopping of the preheating, to preserve the state of the preheating plugs 2, if the start has not begun after a maximum duration TIME_HEATING_MAINTENANCE_MAX.

If COUNTER_HEATING_MAINTENANCE is greater than TIME_HEATING_MAINTENANCE_MAX, the transition $t_3$ is carried out, and heating maintenance is stopped.

Regarding the transition $t_4$, if the engine is in a start phase and the temperature of the engine 1 is less than a maximum threshold temperature $T_{thresh_max}$, or if the temperature of the engine 1 is less than a maximum threshold temperature $T_{thresh_max}$ and the rotation speed $V_{mot}$ of the engine 1 is greater than a minimum threshold rotation speed $TV_{thresh_min}$, the transition $t_4$ is carried out, and the heating phase P2 during the starting of the engine 1 is performed.

The transition $t_5$ is carried out when, during the heating phase P2 during a start of the engine 1, the engine 1 has stalled, and the heating maintenance stop step M15 is carried out.

The transition $t_6$ is carried out when the engine 1 is considered to be autonomous, after having started, and the post-heating phase P3 is then activated.

The transition $t_7$ is carried out at the end of the first post-heating substep M31*a*.

The duration TIME_POST_HEATING_1 of the first post-heating substep M31*a* is a function $F_4$ of the temperature $T_{fc}$ of the coolant, of the atmospheric pressure $P_{atm}$, of the intake air temperature $T_{air}$, desired at the end of the rapid preheating step M13.

If COUNTER_POST_HEATING_1 is greater than $F_4$ ($T_{ge}$; $P_{atm}$; $T_{air}$; $T_{boost}$), the transition $t_7$ is carried out, the first post-heating step M31*a* is stopped, to go on to the second post-heating step M31*b*.

The transition $t_8$ is to the stoppage of the post-heating step M31, either because the duration TIME_POST_HEATING_2 of the second post-heating substep M31*b* has elapsed, or because the rotation speed $V_{rot}$ and the torque $C_{mot}$ of the engine are too high.

The duration TIME_POST_HEATING_2 of the second post-heating substep M31*b* is a function $F_5$ of the temperature $T_{fc}$ of the coolant, of the atmospheric pressure $P_{atm}$, of the intake air temperature $T_{air}$, and of the temperature assumed to be reached at the end of the first post-heating substep M31*a*.

If COUNTER_POST_HEATING_2 is greater than TIME_POST_HEATING_2 (with TIME_POST_HEATING_2=F5 ($T_{gc}$; $P_{atm}$; $T_{air}$; TEMPERATURE_POST_HEATING_1)), or if the rotation speed $V_{mot}$ of the engine 1 is greater than a maximum rotation speed $V_{max}$ and/or the engine torque $C_{mot}$ is greater than a maximum engine torque $C_{max}$, or if the engine has stalled, then the transition $t_8$ is carried out, and the post-heating is stopped.

The transition $t_9$ is used to reactivate the first post-heating substep M31*a*, as long as the duration TIME_POST_HEATING_1 has not elapsed.

If COUNTER_POST_HEATING_1 is less than TIME_POST_HEATING_1, and the rotation speed $V_{mot}$ of the engine 1 is less than a minimum rotation speed $V_{min}$, and/or the engine torque $C_{mot}$ is less than a minimum engine torque $C_{min}$, then the transition $t_9$ is carried out and the first post-heating substep M31*a* is reactivated.

The transition $t_{10}$ is used to reactivate the second post-heating substep M31*b* as long as the maximum post-heating duration allowed DURATION_MAX_POST_HEATING has not elapsed.

When COUNTER_POST_HEATING is less than DURATION_MAX_POST_HEATING, the rotation speed $V_{mot}$ of the engine 1 is less than the minimum rotation speed $V_{min}$, and/or the engine torque $C_{mot}$ is less than the minimum torque $C_{min}$, the transition $t_{10}$ is carried out, and the second post-heating step M31*b* is reactivated.

The transition $t_{11}$ provides a way of omitting the post-heating step M31 if the temperature of the engine 1 or the temperature of the air/fuel mixture in the engine 1 is sufficiently high.

If the temperature of the air/fuel mixture is greater than a minimum threshold temperature $T_{thresh_min}$, and the engine has not stalled, the transition $t_{11}$ is carried out, and the post-heating stop step M32 is activated.

The transition $t_{12}$ is carried out if the alternator is powered up (for example by engaging the contact via the contact switch), and the engine has stalled.

When the transition $t_{12}$ is carried out, the heating maintenance stop step M15 is reactivated.

The transition $t_{13}$ is used to definitively stop the post-heating phase P3.

If COUNTER_POST_HEATING is greater than DURATION_MAX_POST_HEATING, the transition $t_{13}$ is carried out, and the post-heating phase P3 is definitively stopped. The heating stop phase P4 is activated.

The transition $t_{14}$ is carried out if the water temperature of the engine is less than the minimum threshold temperature $T_{thresh_min}$, the engine torque $C_{mot}$ is less than the minimum engine torque $C_{min}$, and the atmospheric pressure $P_{atm}$ is less than a minimum threshold pressure $P_{min}$, and the voltage $U_{bat}$ supplied by the battery 4 is less than a minimum threshold voltage $V_{min}$.

The transition $t_{14}$ can also be carried out via an assistance request to the alternator to respond to a particular thermal need in the engine's combustion chamber.

The intermediate heating step M51 is then activated.

The transition $t_{15}$ is used to stop the intermediate heating beyond a predetermined duration TIME_INTERMEDIATE_HEATING, dependent on the operating conditions of the engine 1.

When COUNTER_INTERMEDIATE_HEATING is greater than TIME_INTERMEDIATE_HEATING, the transition $t_{15}$ is carried out, and the intermediate heating stop step M52 is activated.

The transition $t_{16}$ is carried out if the temperature of the air/fuel mixture is greater than the minimum threshold temperature $T_{thresh_min}$, or if the engine torque $C_{mot}$ is greater than the minimum engine torque $C_{min}$, or if the atmospheric pressure $P_{atm}$ is greater than the minimum threshold pressure $P_{min}$, or if the time counter COUNTER_INTERMEDIATE_HEATING_STOP is greater than a minimum threshold DURATION_INTERMEDIATE_HEATING_MIN.

The heating is then stopped.

Figure 3A:
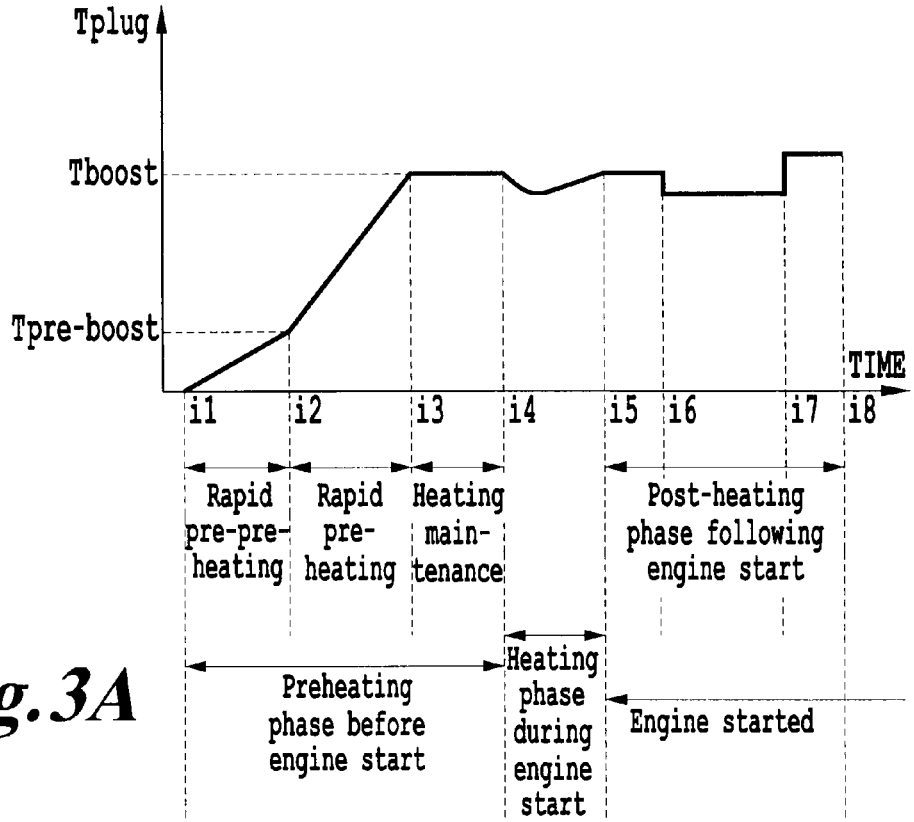
FIG. 3 illustrates an example of operation of a method according to one aspect of the invention.
Figure 3B:
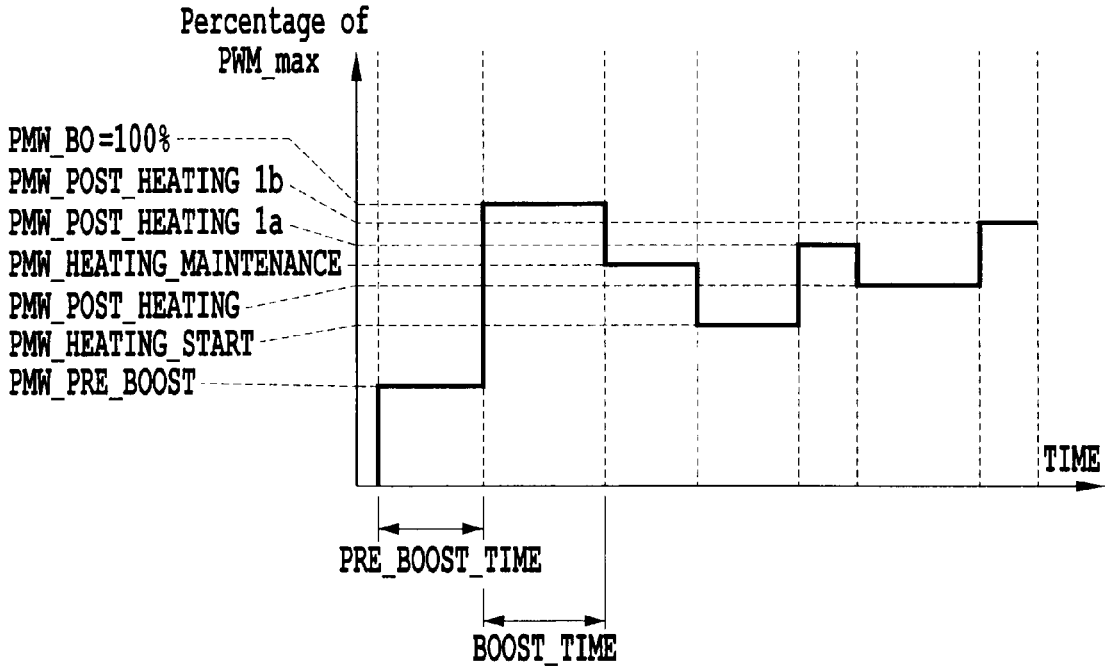

FIG. 3 illustrates an example of operation according to one aspect of the invention.

At an instant $i_1$, the rapid preheating step M12 begins with the power supply to the plugs having an amplitude of PWM_PRE_BOOST % of the maximum amplitude PWM_MAX, and a duration TIME_PRE_BOOST. At the end of this step, the temperature of the plugs 2 or of the air/fuel mixture has increased to $T_{pre_boost}$.

At the instant $i_2$=i1+TIME_PRE_BOOST, the rapid preheating step M13 is activated, with a power supply to the plugs 2 of maximum amplitude PWM_MAX, for a duration TIME_BOOST. The temperature of the air/fuel mixture of the engine has strongly increased during the rapid preheating step M13, to reach $T_{boost}$.

At the instant $i_3$=$i_2$+TIME_BOOST, the heating maintenance step M14 is activated, in order to maintain the temperature of the plugs 2 or of the air/fuel mixture at the temperature $T_{boost}$. To these ends, the amplitude of the power supply to the preheating plugs 2 is PWM_HEATING_MAINTENANCE % of PWM_MAX, until the instant $i_4$ at which the start phase P2 of the engine 1 begins.

During the engine start phase P2, the amplitude of the power supply to the plugs is PWM_HEATING_START % of PWM_MAX, until an instant $i_5$ marking the beginning of the first post-heating step M31*a* following the starting of the engine 1.

Thus, until the instant $i_6$, marking the end of the first post-heating step M31*a*, the plug power supply has an amplitude equal to PWM_POST_HEATING1_A % of PWM_MAX.

From the instant $i_6$ to an instant $i_7$, a second post-heating step M31*b* is activated, with a power supply of amplitude PWM_POST_HEATING2% of PWM_MAX.

Finally, from the instant $i_7$ to the instant $i_8$, the first post-heating step M31*a* is reactivated, with an amplitude of the power supply to the preheating plugs 2 equal to PWM_POST_HEATING1_B % of PWM_MAX.

Thus, the temperature of the air/fuel mixture is rapidly raised to a level enabling the engine 1 to start, and enabling such a temperature to be maintained after the starting of the engine 1.

One difficulty lies in the calibration of the duration of the rapid preheating step M13 taking into account production dispersions of the preheating plugs 2.

Figure 4A:
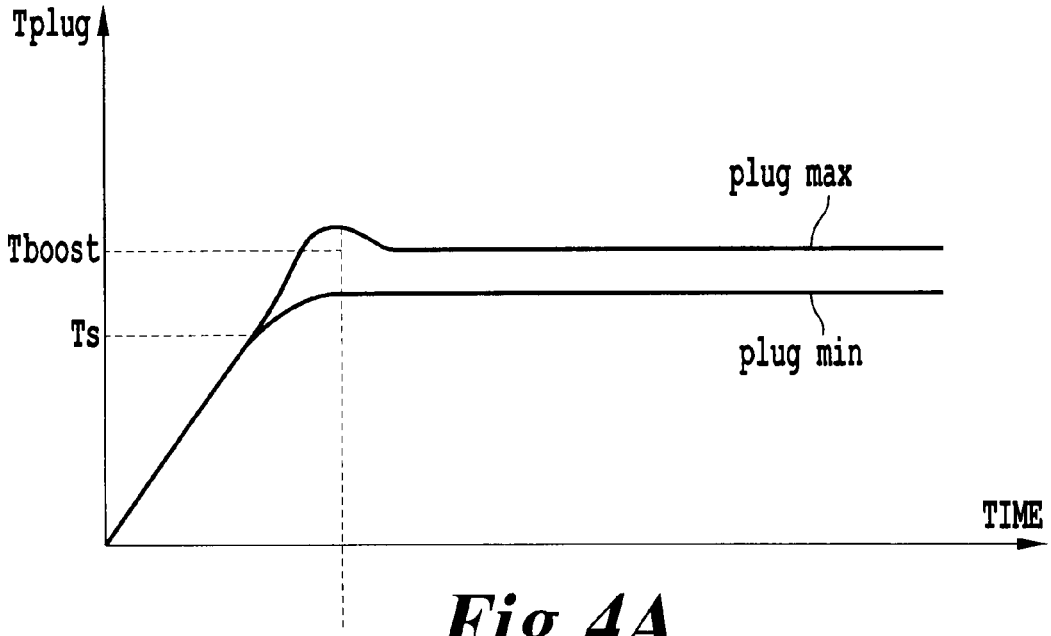
FIGS. 4, 5 and 6 illustrate the taking into account of the production dispersion of the preheating plugs according to one aspect of the invention.
Figure 4B:
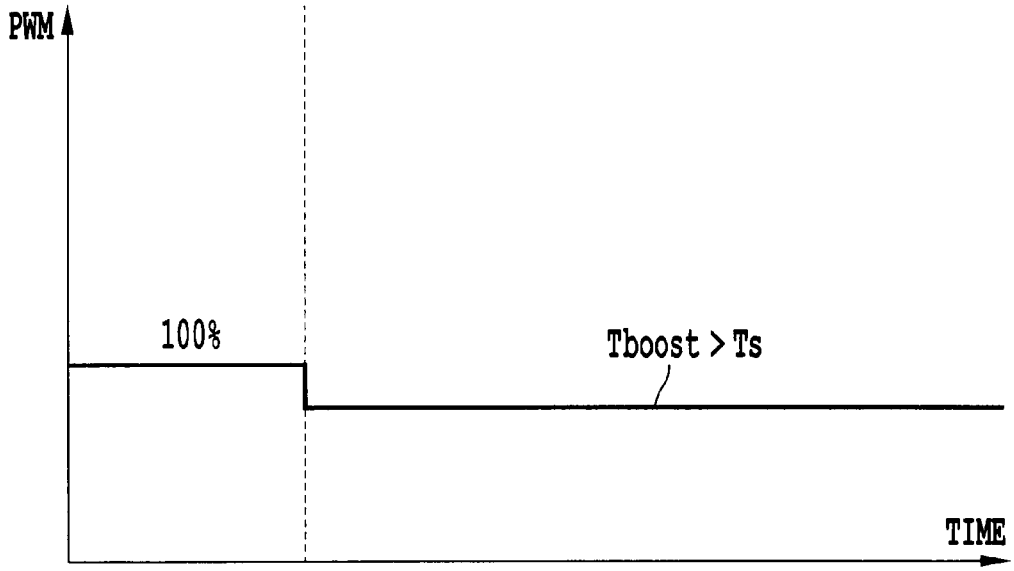
Figure 5A:
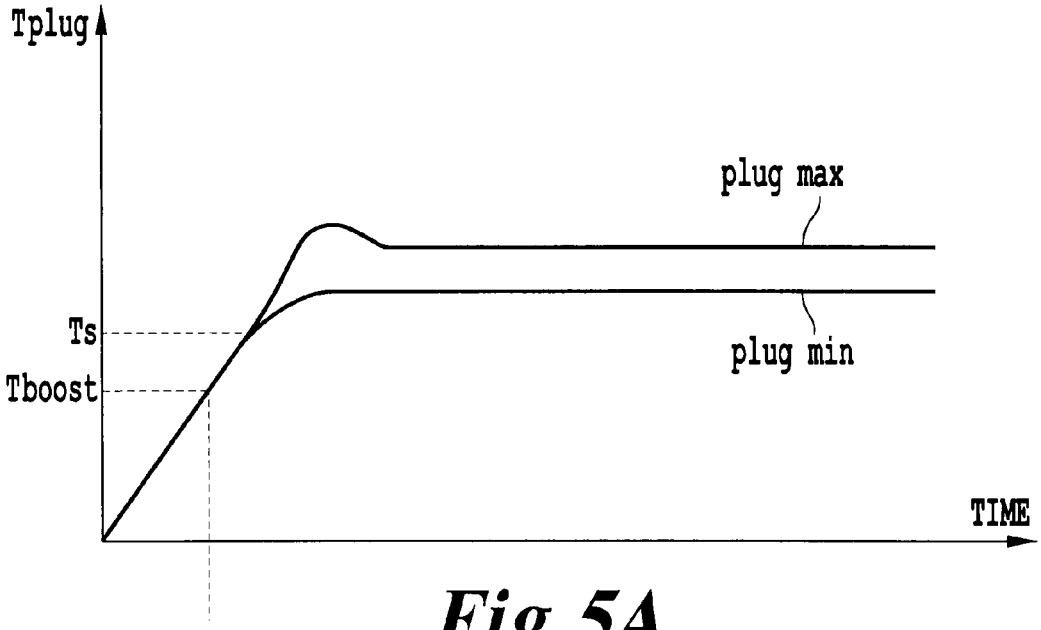
Figure 5B:
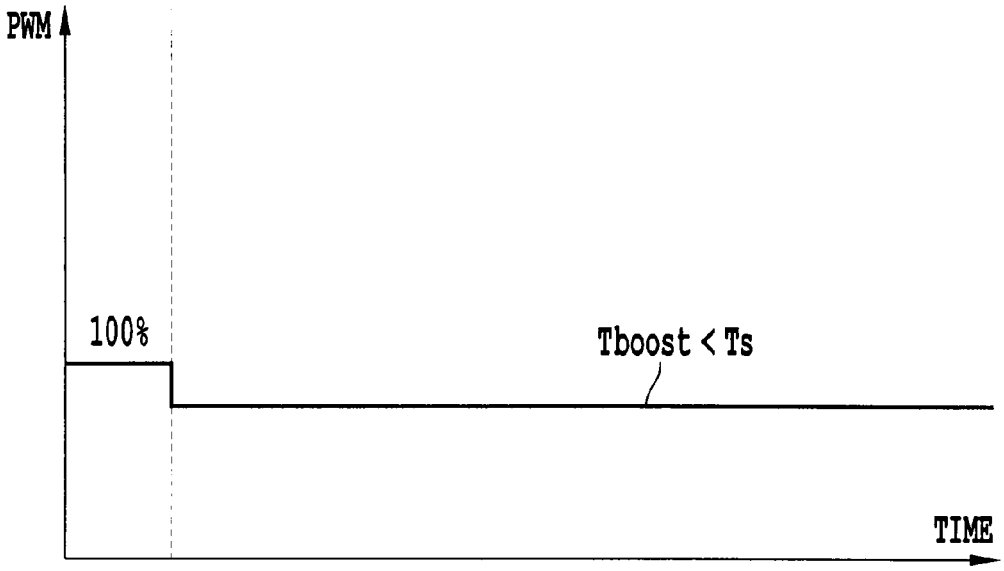

As illustrated in FIGS. 4 and 5, the production dispersions (plug min/plug max) can be significant if the temperature required at the end of the rapid preheating step M13 is greater than a threshold temperature Ts.

In practice, below the threshold temperature Ts, the production dispersion between a plug 2 heating the most (plug max) and a plug 2 heating the least (plug min) has no effect.

If the desired temperature at the end of the rapid preheating step M13 is greater than Ts (FIG. 4), the duration TIME_BOOST of the rapid preheating step M13 is determined from a cartography comprising as input parameters the temperature $T_{fc}$ of the coolant, the atmospheric pressure $P_{atm}$, the intake air temperature $T_{air}$ and the voltage $U_{bat}$ supplied by the battery 4.

If the temperature desired at the end of the rapid preheating step M13 is less than Ts (FIG. 5), the duration TIME_BOOST of the rapid preheating step M13 is governed by the equation:

$$\text{TIME_BOOST} = \text{TIME_REF}\left(\frac{U_{bat_ref}}{U_{bat}}\right) \quad (1)$$

in which:

TIME_BOOST is the duration of the rapid preheating step M13, $U_{bat}$ is the voltage supplied by the battery.

TIME_REF is a reference duration to reach the desired temperature of the plug at a reference voltage from the battery 4, and at an ambient temperature of 20° C.

$U_{bat_ref}$ is the reference voltage of the battery.

Furthermore, it is possible to perform a correction of the amplitude of PWM of the power supply to the plugs 2.

FIG. 4 illustrates the production dispersion characteristics of the plugs 2. It appears that the desired temperature at the end of the rapid preheating step M13 cannot be guaranteed with plugs min supplying a minimum temperature in the range of temperatures due to production dispersion. There is then a strong risk of bad startup or non-startup.

In order to overcome this risk of bad startup or non-startup, the amplitude PWM of the voltage power supply applied to the plugs is increased progressively, if a bad startup or a non startup is detected.

Figure 6A:
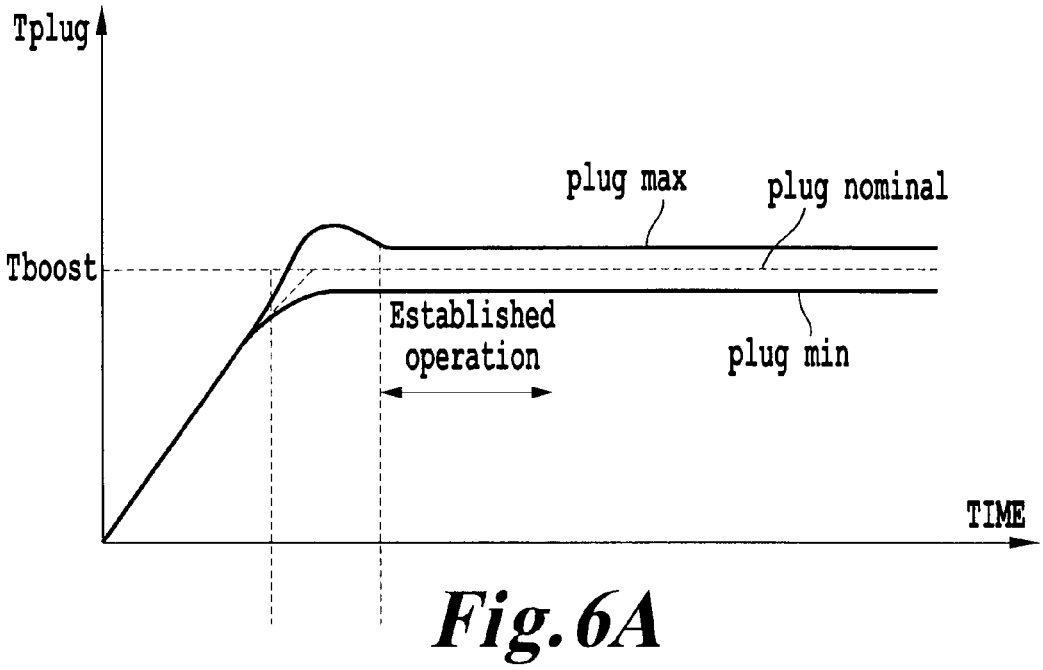
Figure 6B:
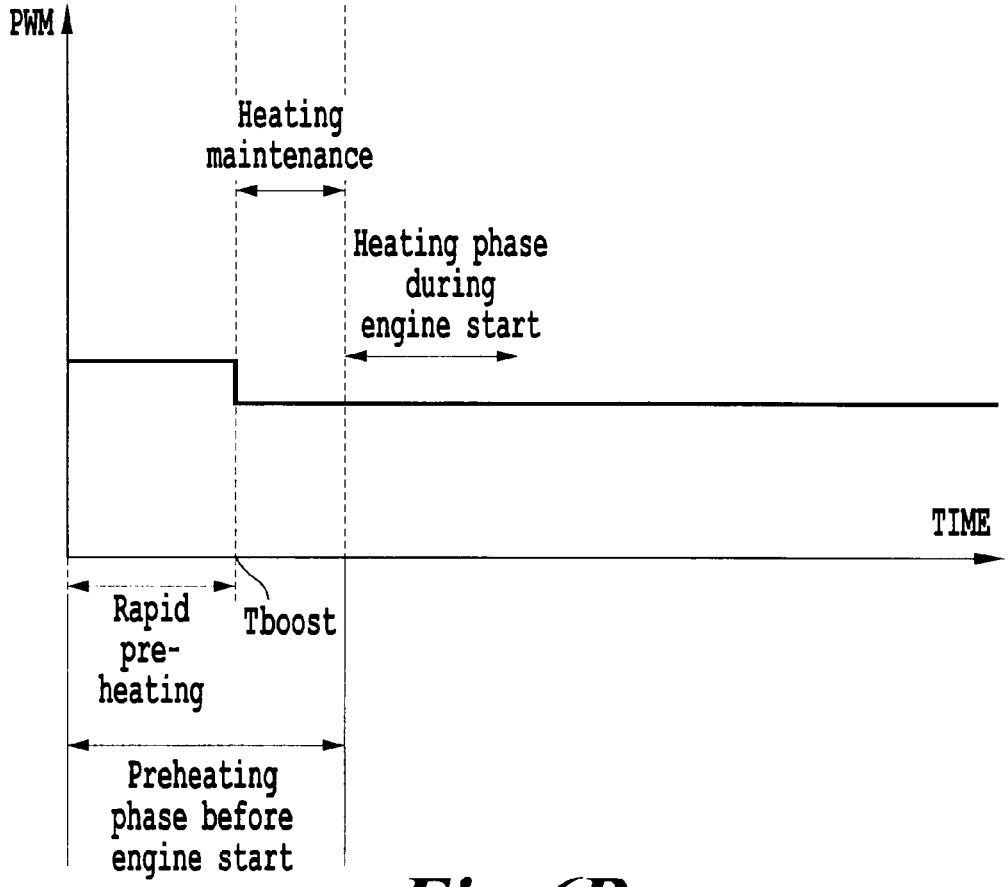

When the engine enters into the start phase, the plugs 2 are assumed to be powered in steady state conditions, with a power supply amplitude PWM less than 100% (as illustrated in FIG. 6).

In this case, any controlled increase in the amplitude PWM of the power supply or voltage applied to the plugs 2 (whether min or max) will not result in exaggerated overheating.

Figure 7:
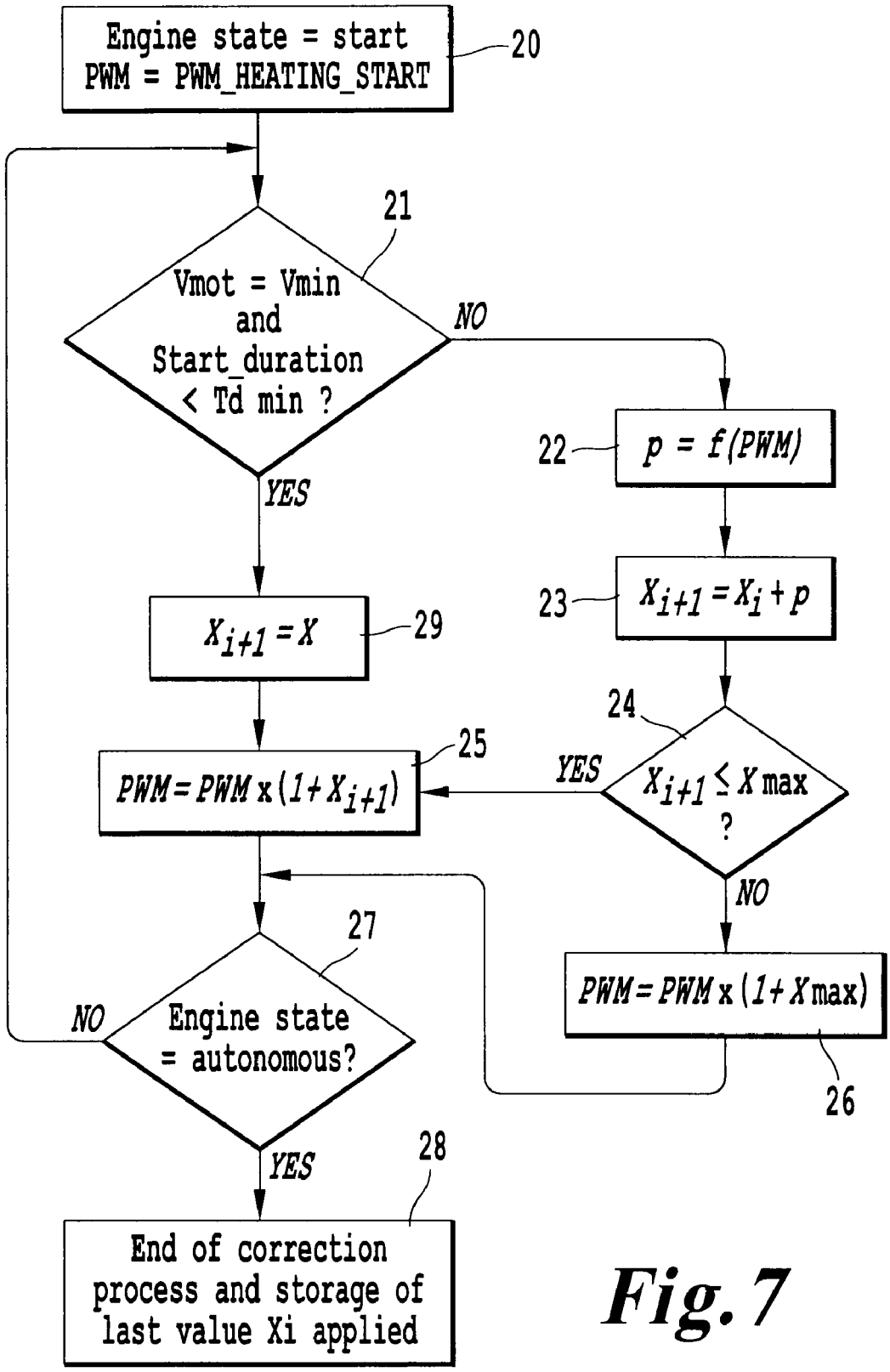
FIG. 7 illustrates the taking into account of the production dispersion of the plugs in an implementation of a method according to one aspect of the invention.

Consequently, if, in the start phase (step 20), the rotation speed $V_{mot}$ of the engine 1 does not reach the minimum rotation speed $V_{min}$ in a given time td_min (step 21), the amplitude PWM is corrected, as explained in FIG. 7, in order to progressively increase the temperature of the plug.

A predetermined correction p, expressed as a percentage, dependent on the current value of the amplitude PWM, is applied (step 22).

There follows a correction $X_i$, governed by $X_{i+1}=X_{i+p}$ (step 23) to correct the predetermined amplitudes PWM by a multiplying factor $1+X_{i+1}$ (step 25).

Moreover, $X_i$ cannot exceed a predetermined maximum value $X_{max}$ (steps 24 and 26), in order to guarantee the protection of the plugs 2.

The last correction Xi applied to the power supply amplitude PWM before the engine 1 is recognized to be autonomous, is stored in memory (steps 27). It is directly used on the next iteration (step 29).

The adaptation ends when the engine 1 becomes autonomous (step 28), because the process concerns only the amplitude PWM on starting.

Thus, this learning process makes it possible to ensure a start with plugs min presenting an end-of-rapid-preheating temperature $T_{boost}$ that is well below that obtained with nominal plugs.

Also, as represented in FIG. 6, the rapid preheating time TIME_BOOST can be adjusted on a plug max, in order to make it possible to limit the rise in temperature or overheating of the plugs max when the method is applied. If necessary, the learning process can be performed over several starts.

It would also be possible to envisage performing corrections dependent on operating parameters of the engine 1.

Figure 8:
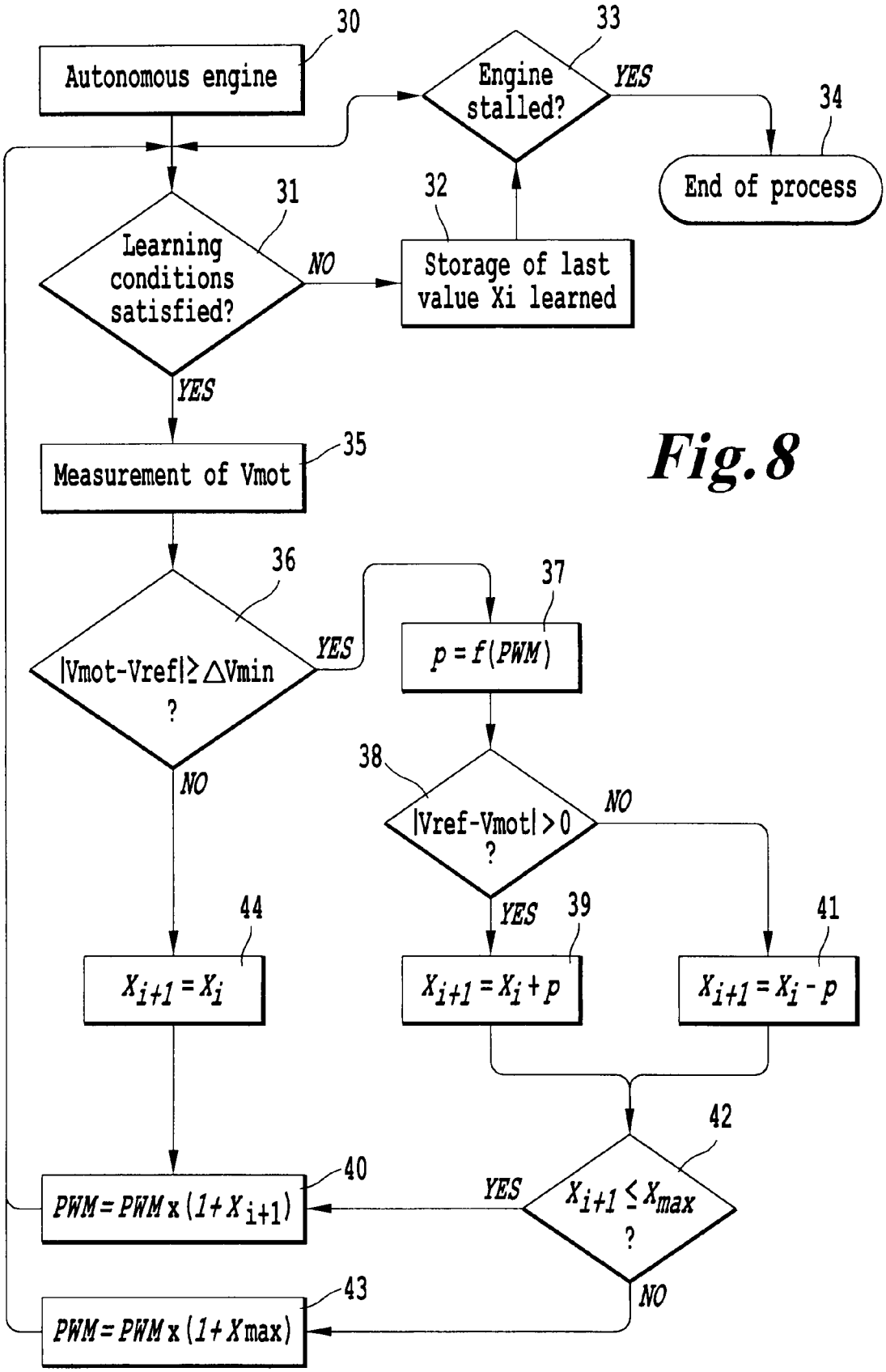
FIG. 8 illustrates the taking into account of the wear over time of the plugs in a method according to one implementation of the invention.

Furthermore, it is possible to take account of the deterioration of the preheating plugs 2 and their operating changes over time (FIG. 8).

Aging preheating plugs can strongly impair the operation of the engine 1 (bad start, instabilities when slowing down, combustion requirements at altitude not satisfied, etc.).

Thus, to overcome these various types of drawbacks, the amplitude PWM applied to the plugs 2 over time is adapted to the changes in behavior of the plugs 2.

The rotation speed $V_{mot}$ of the engine is analyzed in operating conditions of the engine 1 when slowing down (steps 30 and 31). An analysis can be carried out in post-heating or in intermediate heating. In this respect, a condition for transition to intermediate heating can be a learning request.

It is essential to check the absence of failures and the non-activation of strategies that might disrupt the necessary measurements (steps 32, 33 and 34).

The rotation speed $V_{mot}$ of the engine is supplied by a rotation speed sensor of the engine 1. The speed $V_{mot}$ can be evaluated at an average over one or more cycles of two engine revolutions when the requisite operating conditions of the engine 1 are satisfied (step 35).

The reference average speed $V_{ref}$ is, for example, established when the engine is new. The amplitude PWM is corrected when the difference ΔV between the measured average speed $V_{avg}$ and the reference speed $V_{ref}$ exceeds a minimum threshold $\Delta V_{min}$. The adaptation is carried out as long as the requisite conditions are met and as long as the difference at an absolute value remains greater than the predetermined threshold $\Delta V_{min}$ (step 36 and 37).

If the difference is positive (step 38), an attempt is made to increase the amplitudes PWM (steps 39 and 40).

If, however, the difference is negative (step 38), an attempt is made to reduce the amplitudes PWM (steps 41 and 40).

A correction p, expressed as a percentage, dependent on the current amplitude value PWM, is applied. There follows from this a correction Xi, which is such that $X_{i+1}=X_{i+p}$ when an attempt is made to increase the amplitudes PWM (steps 39 and 40), and such that $X_{i+1}=X_{i-p}$ when an attempt is made to reduce the amplitudes PWM (steps 41 and 40).

Moreover, Xi cannot exceed a predetermined maximum value $X_{max}$ (steps 42 and 43), in order to guarantee the protection of the preheating plugs 2.

The last correction Xi applied to the amplitude PWM is kept in memory. On the next iteration, the correction factor F_COR=1+Xi is applied to the predetermined PWMs on heating the plugs (step 44).

As a variant, the management of the controlled amplitude of the power supply voltage supplied to the plugs can be adapted automatically using a PI (Proportional Integral) corrector or regulator.

To these ends, an indication representative of the temperature of the plugs 2 or of the air/fuel mixture must be returned to the electronic control unit 6.

Either the plugs 2 and/or the control module 5 are equipped with a device that makes it possible to directly measure the temperature of the plugs, or the control module 5 is equipped with a device making it possible to measure or estimate the voltage U and the current I consumed by the heating element of the plug.

The ratio U/I can be used to deduce the instantaneous resistance of the heating element, and this instantaneous resistance value has a corresponding plug or air/fuel mixture temperature value.

The determination of a temperature set point for each heating step or phase instead of a control amplitude PWM is predetermined according to engine operating conditions (temperature $T_{fc}$ of the coolant, intake air temperature, atmospheric pressure $P_{atm}$, voltage $U_{bat}$ supplied by the battery, rotation speed $V_{mot}$ of the engine, and engine torque $C_{mot}$).

It is constantly or recurrently compared to the indication representative of the temperature of the plug returned to the electronic control unit 6. Depending on the temperature difference ΔT between the set point temperature representative of the real temperature, the PI regulator automatically regulates the control amplitude PWM in order to maintain the temperature of the plug 2 roughly equal to the set point temperature.

Furthermore, a better management of the rapid preheating phases follows from this, because, with this automatic correction of PWM according to the temperature of the plug, even if the cooling time is not sufficient, the quantity of energy sent on a new rapid preheating phase is always appropriate. Thus, the protection of the plug and the engine start service are simultaneously guaranteed.

The adjustments of the PI regulator are performed by means of conventional models known to those skilled in the art.

The invention claimed is:

1. A method of controlling a low-voltage-powered plug for preheating a diesel engine air/fuel mixture, said plug being voltage-powered by pulses having a predetermined amplitude and duration, the amplitude being less than a maximum amplitude, wherein the amplitudes and the durations of the voltage pulses powering said plug are managed according to first parameters comprising preceding pulse durations and durations separating successive preceding pulses.

2. The method as claimed in claim 1, in which said first parameters also comprise engine operating parameters, and/or an available electrical voltage from which is supplied the electric voltage powering said plug, and/or an indication representative of the activation/deactivation of the alternator of the engine, and/or a desired temperature to be supplied by said plug.

3. The method as claimed in claim 2, in which said operating parameters of the engine comprise the temperature of the coolant regulating the temperature of the engine, and/or atmospheric pressure, and/or the temperature of the fresh intake air of the engine, and/or the rotation speed of the engine.

4. The method as claimed in claim 1, in which said management of the pulses comprises a preheating phase that can be implemented before starting the engine when the alternator is activated.

5. The method as claimed in claim 4, in which said preheating phase comprises a rapid preheating step implemented by one of said pulses of amplitude equal to said maximum amplitude.

6. The method as claimed in claim 5, in which said preheating phase also comprises a preliminary rapid preheating step implemented by one of said pulses of a predetermined amplitude less than said maximum amplitude.

7. The method as claimed in claim 5, in which the production dispersion of the plug is taken into account, by mapping the duration of the pulse of said rapid preheating step, when the desired temperature to be supplied by the plug is greater than a threshold temperature, and by calculating the duration of the pulse of said rapid preheating step according to the square of the ratio of a reference electrical voltage and of an available electrical voltage from which is supplied the electrical voltage powering said plug, and according to a reference duration for reaching the desired temperature to be supplied by the plug under said reference electrical voltage at a reference temperature.

8. The method as claimed in claim 1, in which said management of the pulses comprises a heating phase that can be implemented while starting the engine.

9. The method as claimed in claim 8, in which the production dispersion of the plug is taken into account, by progressively increasing the amplitude of said pulse of the heating phase on starting up the engine.

10. The method as claimed in claim 9, in which the amplitude of said pulse is increased when, on startup, the rotation speed of the engine does not reach a first predetermined rotation speed in a first predetermined duration.

11. The method as claimed in claim 10, in which said progressive increase in the amplitude of the pulse is a function of said amplitude of the pulse, and is less than a maximum increase.

12. The method as claimed in claim 1, in which said management of the pulses comprises a post-heating phase that can be implemented after starting the engine.

13. The method as claimed in claim 1, in which said management of the pulses comprises a heating stop phase.

14. The method as claimed in claim 1, in which said management of the pulses comprises a top-up heating phase that can be implemented when the engine is running.

15. The method as claimed in claim 1, in which the wear over time of said plug is taken into account, by adapting the amplitudes of said pulses over the course of the time, by using a corrective factor dependent on the difference between a measured rotation speed of the engine and a reference rotation speed of the engine for a reference operating point of the engine.

16. The method as claimed in claim 1, in which the temperature supplied by said plug is evaluated, and the amplitude of said predetermined pulses is adapted by using a closed loop proportional integral regulator.

17. A system for controlling a low-voltage-powered plug for preheating a diesel engine fuel-air mixture, comprising controlled means of supplying voltage power to said plug adapted to deliver pulses having a predetermined amplitude and duration, the amplitude being less than a maximum amplitude, and comprising an electronic control unit provided with means of managing said power supply means, said electronic control unit being able to remain powered with voltage for a predetermined duration after a stoppage of the engine, characterized in that said management means comprise means of determining the value of first parameters comprising preceding pulse durations and durations separating successive preceding pulses.

* * * * *